US010234799B2

(12) United States Patent
Himeno

(10) Patent No.: US 10,234,799 B2
(45) Date of Patent: Mar. 19, 2019

(54) IMAGE FORMING APPARATUS WITH AN ADJUSTABLE PEELING GUIDE

(71) Applicants: KABUSHIKI KAISHA TOSHIBA, Tokyo (JP); TOSHIBA TEC KABUSHIKI KAISHA, Tokyo (JP)

(72) Inventor: Satoshi Himeno, Mishima Shizuoka (JP)

( * ) Notice: Subject to any disclaimer, the term of this patent is extended or adjusted under 35 U.S.C. 154(b) by 0 days.

(21) Appl. No.: 15/391,622

(22) Filed: Dec. 27, 2016

(65) Prior Publication Data

US 2018/0181034 A1 Jun. 28, 2018

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS 9,618,890 B2 * 4/2017 Kondo ..... G03G 15/2032
2005/0008408 A1 1/2005 Inomata
2009/0003897 A1 * 1/2009 Yamada ..... G03G 15/2028 399/323
2010/0215413 A1 * 8/2010 Nakajima ..... G03G 15/2028 399/323
2012/0224893 A1 * 9/2012 Yamamoto ..... G03G 15/2028 399/323
2014/0119781 A1 * 5/2014 Okuno ..... G03G 15/0812 399/284
2015/0117920 A1 * 4/2015 Moteki ..... G03G 15/2028 399/323
2015/0160587 A1 * 6/2015 Seki ..... G03G 15/0275 399/100

FOREIGN PATENT DOCUMENTS

JP 05027602 A * 2/1993

* cited by examiner

*Primary Examiner* — Francis C Gray
(74) *Attorney, Agent, or Firm* — Kim & Stewart LLP

(57) ABSTRACT

An image forming apparatus includes a rotating member configured to transport a sheet in a sheet transporting direction, a pressing member configured to form a nip with the rotating member, a peeling guide, and an adjusting device. The peeling guide is disposed on a downstream side of the rotating member in the sheet transporting direction, has a longitudinal side extending along an axial direction of the rotating member, and is configured to separate the sheet from the rotating member. The adjusting device is controlled to move the peeling guide to adjust a gap between an intermediate portion of the peeling guide and the rotating body by a greater amount than gaps between longitudinal ends of the peeling guide and the rotating body.

21 Claims, 5 Drawing Sheets

IMAGE FORMING APPARATUS WITH AN ADJUSTABLE PEELING GUIDE

FIELD

Embodiments described herein relate generally to an image forming apparatus.

BACKGROUND

Conventionally, an image forming apparatus such as a Multi Function Peripheral (hereinafter, referred to as "MFP") can be used with a printer. The image forming apparatus includes a fixing device and a peeling guide. The fixing device includes a belt. The belt transports a sheet. The peeling guide separates the sheet from the belt. The peeling guide has a longitudinal side that extends along a width direction of the belt. A gap between the peeling guide and the belt is usually set only at the two ends of the peeling guide in the longitudinal direction. This can result in an uneven gap in the longitudinal direction of the peeling guide.

DETAILED DESCRIPTION

Figure 1:
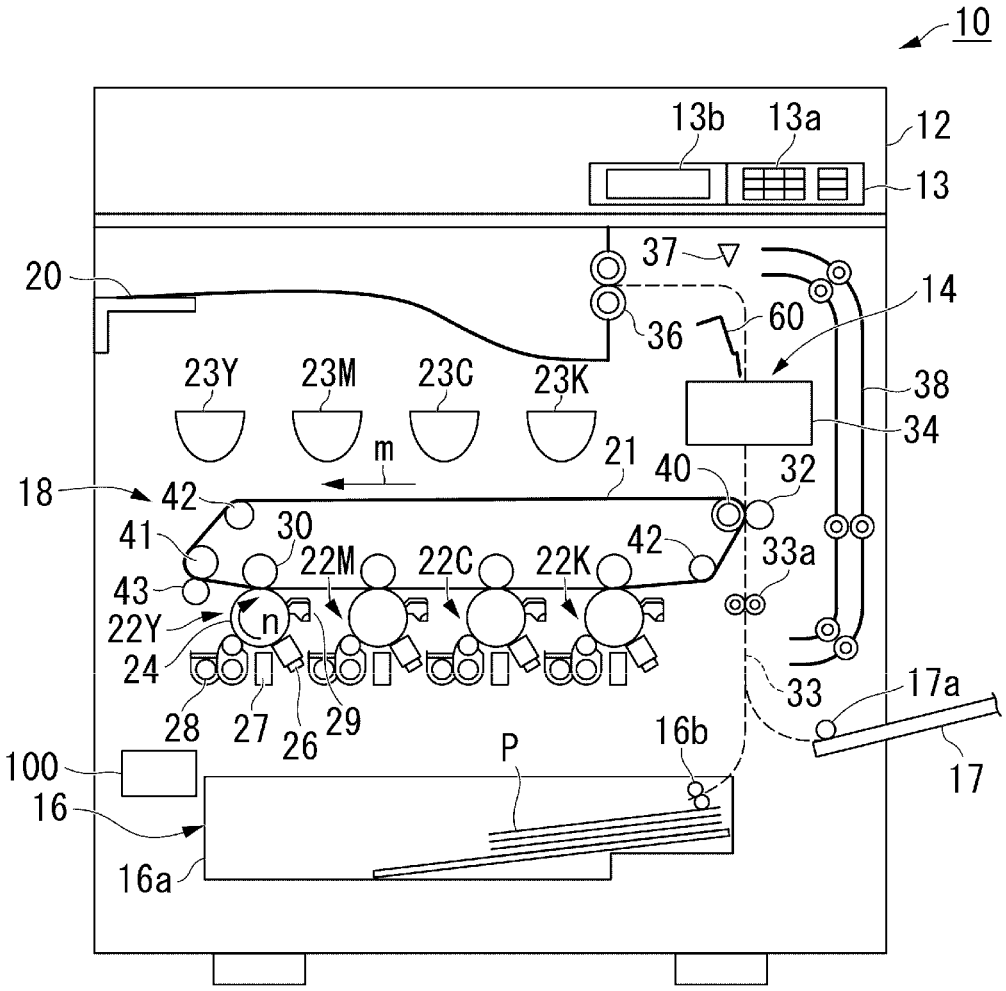
FIG. 1 illustrates an example of an image forming apparatus of an embodiment.

An image forming apparatus of an embodiment includes a rotating member configured to transport a sheet in a sheet transporting direction, a pressing member configured to form a nip with the rotating member, a peeling guide, and an adjusting device. The peeling guide is disposed on a downstream side of the rotating member in the sheet transporting direction, has a longitudinal side extending along an axial direction of the rotating member, and is configured to separate the sheet from the rotating member. The adjusting device is controlled to move the peeling guide to adjust a gap between an intermediate portion of the peeling guide and the rotating body by a greater amount than gaps between longitudinal ends of the peeling guide and the rotating body.

Hereinafter, an image forming apparatus 10 of an embodiment will be described with reference to the drawings. Moreover, in each figure, the same reference numerals are given to the same elements.

FIG. 1 illustrates an example of the image forming apparatus 10 of the embodiment. Hereinafter, an MFP 10 will be described as an example of the image forming apparatus 10.

The MFP 10 includes a scanner 12, a control panel 13, and a system control unit 100 that is a control unit for integrally controlling each control unit. The MFP 10 includes a sheet feeding cassette portion 16, a printer portion 18, and the like.

The scanner 12 reads a document image. The control panel 13 includes an input device 13*a*, which may be a keypad or panel, and a display portion 13*b*. For example, the input device 13*a* receives an input from a user. For example, the display portion 13*b* is a touch panel type. The display portion 13*b* may also receive an input from the user and performs a display to the user.

The sheet feeding cassette portion 16 includes a sheet feeding cassette 16*a* and a pickup roller 16*b*. The sheet feeding cassette 16*a* stores sheets P. The pickup roller 16*b* removes the sheet P from the sheet feeding cassette 16*a* and feeds the sheet P.

In addition, MFP 10 includes a transport roller. The transport roller transports the sheet P along a transporting path 33. The transport roller transports the sheet P from the sheet feeding cassette portion 16 or the sheet feeding tray 17 to a sheet discharging unit 20 along the transport path 33. The transporting path 33 includes a plurality of guide elements for guiding the sheet P.

The printer portion 18 forms an image. For example, the printer portion 18 forms and image from the document data which is read by the scanner 12. The printer portion 18 includes an intermediate transfer belt 21. The printer portion 18 supports the intermediate transfer belt 21 using a backup roller 40, a driven roller 41, and a tension roller 42. The backup roller 40 includes a driving portion (not illustrated). The printer portion 18 rotates the intermediate transfer belt 21 in an arrow direction m.

The printer portion 18 includes four image forming stations 22Y, 22M, 22C, and 22K. Each of the image forming stations 22Y, 22M, 22C, and 22K is provided for forming each portion of an image in colors of Y (yellow), M (magenta), C (cyan), and K (black). The image forming stations 22Y, 22M, 22C, and 22K are disposed in parallel on a lower side of the intermediate transfer belt 21 along a rotating direction of the intermediate transfer belt 21.

The printer portion 18 includes each of cartridges 23Y, 23M, 23C, and 23K above each of the image forming stations 22Y, 22M, 22C, and 22K. Each of the cartridges 23Y, 23M, 23C, and 23K stores each replenishing toner of Y (yellow), M (magenta), C (cyan), and K (black).

Hereinafter, the image forming station 22Y of Y (yellow) among the image forming stations 22Y, 22M, 22C, and 22K will be described as an example. Moreover, since the image forming stations 22M, 22C, and 22K include the same configurations as that of the image forming station 22Y, detailed description of the image forming stations 22M, 22C, and 22K will be omitted.

The image forming station 22Y includes an electric charger 26, an exposure scanning head 27, a developing device 28, and a photoreceptor cleaner 29. The electric charger 26, the exposure scanning head 27, the developing device 28, and the photoreceptor cleaner 29 are disposed around a photoreceptor drum 24 rotating in an arrow direction n.

The image forming station 22Y includes a primary transfer roller 30. The primary transfer roller 30 faces the photoreceptor drum 24 via the intermediate transfer belt 21.

The image forming station 22Y charges the photoreceptor drum 24 using the electric charger 26 and then exposes the photoreceptor drum 24 using the exposure scanning head 27. The image forming station 22Y forms an electrostatic latent image on the photoreceptor drum 24. The developing device 28 develops the electrostatic latent image on the photoreceptor drum 24 using two-component developer formed by toner and carrier.

The primary transfer roller 30 primarily transfers a toner image formed on the photoreceptor drum 24 to the intermediate transfer belt 21. The image forming stations 22Y, 22M, 22C, and 22K form a color toner image on the intermediate transfer belt 21 using a respective primary transfer roller 30. The color toner image is formed by subsequently superposing the toner images of Y (yellow), M (magenta), C (cyan), and K (black) colors. The photoreceptor cleaner 29 removes toner remaining in the photoreceptor drum 24 after the primary transfer.

The printer portion 18 includes a secondary transfer roller 32. The secondary transfer roller 32 faces the backup roller 40 with the intermediate transfer belt 21 between the secondary transfer roller 32 and the backup roller 40. The secondary transfer roller 32 secondarily transfers the color toner image on the intermediate transfer belt 21 to the sheet P. The sheet P is fed from the sheet feeding cassette portion 16 or the manual sheet feeding tray 17 along the transporting path 33.

The printer portion 18 includes a belt cleaner 43 facing the driven roller 41 with the intermediate transfer belt 21 between the belt cleaner 43 and the driver roller 41. The belt cleaner 43 removes toner remaining on the intermediate transfer belt 21 after the secondary transfer to the sheet P.

The printer portion 18 includes a registration roller 33*a*, a fixing device 34, and a sheet discharging roller 36 along the transporting path 33. The printer portion 18 includes a peeling guide 60, an adjusting device 70 (see FIG. 2), a branch portion 37, and a reverse transport portion 38 on a downstream side of the fixing device 34 in the sheet transport direction.

The peeling guide 60 directs the sheet P from the fixing device 34 to the branch portion 37. The branch portion 37 directs the sheet P to the sheet discharging unit 20 or the reverse transport portion 38. In a case of duplex printing, the reverse transport portion 38 reverses and transports the sheet P from the branch portion 37 toward the registration roller 33*a*. The MFP 10 forms a fixed toner image on the sheet P using the printer portion 18 and discharges the sheet P to the sheet discharging unit 20.

Moreover, the MFP 10 is not limited to a tandem developing system and the number of the developing devices 28 is also not limited to the embodiment. In addition, the MFP 10 may directly transfer the toner image on the sheet P from the photoreceptor drum 24.

As described above, the sheet P is transported from the sheet feeding cassette portion 16 to the sheet discharging unit 20.

Hereinafter, a sheet feeding cassette portion 16 side is referred to as "upstream side" in a transporting direction v (see FIG. 2) of the sheet P. In addition, a sheet discharging unit 20 side is referred to as "downstream side" in the transporting direction v (see FIG. 2) of the sheet P.

Hereinafter, a main portion of the image forming apparatus 10 will be described.

Figure 2:
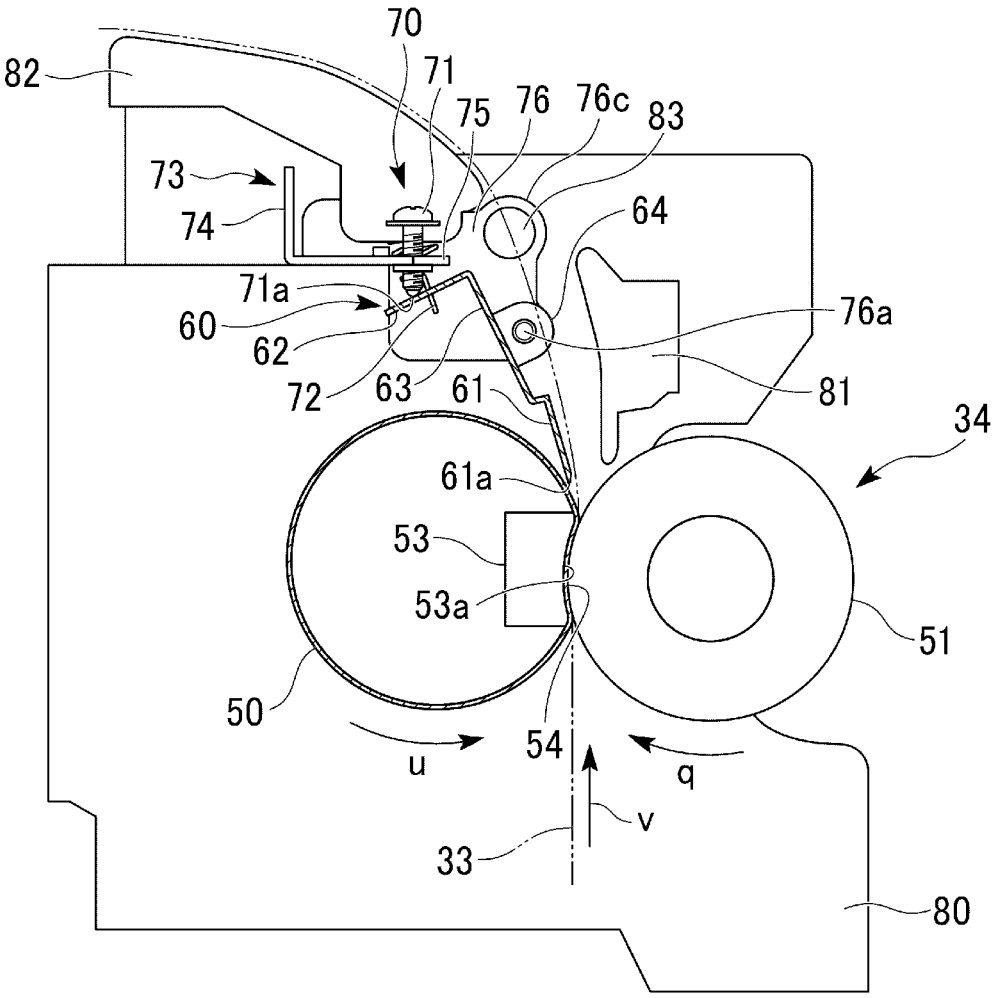
FIG. 2 is a side view of a main portion of the image forming apparatus of the embodiment.

FIG. 2 is a side view of the main portion of the image forming apparatus 10 according to the embodiment.

First, the fixing device 34 will be described.

As illustrated in FIG. 2, the fixing device 34 includes a belt 50 (rotating member) and a press roller 51. The fixing device 34 fixes the toner image on the sheet P using heat from the belt 50 and pressure from the press roller 51.

A portion of the belt 50 defines a portion of the transporting path 33. The belt 50 is formed along the transporting path 33. The belt 50 transports the sheet P. The belt 50 is a cylindrical endless belt. A nip pad 53 is disposed on an inner side of the belt 50. The belt 50 includes a heating layer (conductive layer) that is a heating portion. The heating layer of the belt 50 is heated by an induced current using an electromagnetic induction heating system (hereinafter, referred to as "IH system"). For example, the heating layer may be formed of nickel, iron (Fe), stainless steel, aluminum (Al), silver (Ag), and the like. The heating layer may use an alloy of two or more metals or may be formed of layers of two or more metals or alloys.

For example, a high-frequency magnetic field is generated around a main coil by causing a high-frequency current to flow through the main coil of an IH coil unit (not shown). An eddy current is generated in the heating layer of the belt 50 by a magnetic flux of the high-frequency magnetic field. Joule heat is generated in the heating layer by the eddy current and an electrical resistance of the heating layer. The belt 50 is heated by the generation of the Joule heat.

The nip pad 53 presses against an inner surface of the belt 50, pressing the belt 50 against the press roller 51. The nip pad 53 is biased toward the press roller 51 by a biasing member (not shown) such as a spring. A nip 54 is formed between the belt 50 and the press roller 51. The nip pad 53 has a nip forming surface 53*a* for forming the nip 54 between the belt 50 and the press roller 51. The nip forming surface 53*a* is curved on the inner side of the belt 50 when viewed along a width direction (hereinafter, referred to as "belt width direction") of the belt 50. The nip forming surface 53*a* is curved along an outer surface of the press roller 51 when viewed along the belt width direction. Moreover, the belt width direction corresponds to an axial direction w (see FIG. 5) of the belt 50.

For example, the nip pad 53 may be formed of an elastic material such as silicone rubber and fluorine rubber. The nip pad 53 may be formed of a heat-resistant resin such as polyimide resin (PI), polyphenylene sulfide resin (PPS), polyether sulfone resin (PES), liquid crystal polymer (LCP), and phenol resin (PF).

The press roller 51 is a press member to press the belt 50. For example, the press roller 51 includes a heat-resistant silicone sponge, a silicone rubber layer, and the like around a core metal. For example, a release layer is disposed on a surface of the press roller 51. The release layer is formed of a fluorine-based resin such as PFA resin. The press roller 51 presses the belt 50 using a pressing device (not illustrated).

The press roller 51 is rotated by a motor (not shown) in an arrow direction q. The belt 50 is rotated in an arrow direction u by being driven by the press roller 51 when the belt 50 abuts against the press roller 51. The belt 50 is rotated in the arrow direction u by the motor when the belt 50 moves away from the press roller 51. Moreover, the belt 50 may include a driving source independently from the press roller 51.

The sheet P passes through the nip 54 between the belt 50 and the press roller 51 along the transporting path 33. The peeling guide 60 is provided on a downstream side of the fixing device 34 in the transporting direction v of the sheet P. The peeling guide 60 is disposed on the downstream side of the belt 50 and an upstream side of the sheet discharging unit 20 (see FIG. 1). The peeling guide 60 initially comes into contact with the sheet P after fixing at the fixing device 34.

Moreover, in FIG. 2, a frame 80 supports the fixing device 34, the adjusting device 70, and the like. In addition, transport guides 81, 82 guide the sheet P.

Next, outer shapes of the belt 50 and the press roller 51 will be described.

Figure 3:
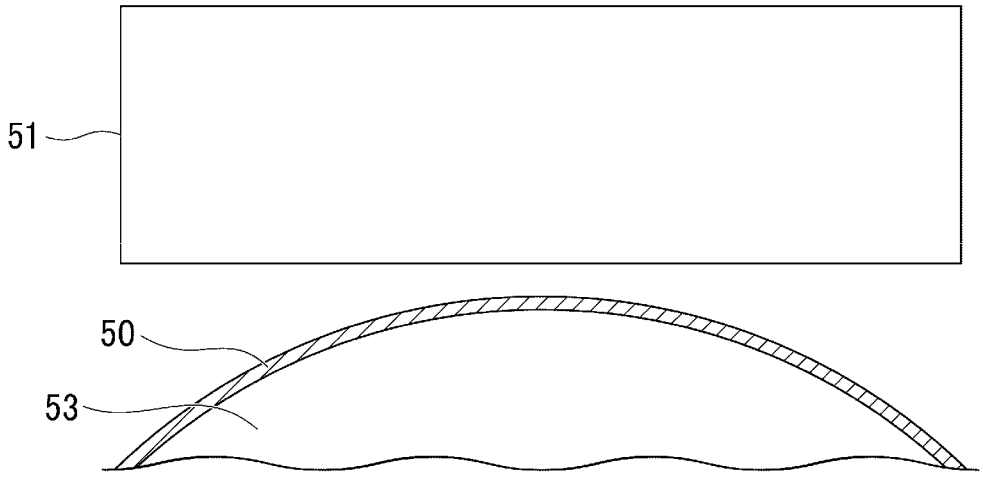
FIG. 3 illustrates an example of outer shapes of a belt and a press roller of the embodiment.

FIG. 3 illustrates an example of the shapes of the belt 50 and the press roller 51 of the embodiment. In FIG. 3, the press roller 51 and belt 50 are shown separated to illustrate their shapes when not in contact with each other. The view of FIG. 3 is along the transporting direction v of the sheet P (see FIG. 2).

As illustrated in FIG. 3, the outer surface of the press roller 51 is flat along a longitudinal direction (parallel to the page in FIG. 3). The outer surface of the nip pad 53 is convex at a center of the nip pad 53 in the longitudinal direction. The outer surface of the belt 50 (the surface that presses against the press roller 51) is also convex at a center of the belt 50 in the longitudinal (width) direction. For the sake of convenience, the curvature of the nip pad 53 and the belt 50 are exaggerated in FIG. 3. For example, the center portion of the belt 50 in the belt width direction protrudes 0.3 mm to 0.35 mm with respect to end portions in the belt width direction. That is, the outer surface of the belt 50 has an arc shape along the belt width (longitudinal) direction that is gently curved about an axis perpendicular to the longitudinal direction, the belt width direction, and the axial direction w (see FIG. 5). Thus, if a central axis of the belt 50 is defined extending in the belt width direction and the longitudinal direction, the center of the belt 50 in the belt width direction is further from the central axis of the belt 50 than end portions of the belt 50, which is visible when viewed along the transporting direction v of the sheet P. Therefore, where the belt 50 abuts against the press roller 51, the belt 50 is flattened in the belt width direction.

Next, the peeling guide 60 will be described.

As illustrated in FIG. 2, the peeling guide 60 separates the sheet P from the belt 50. The peeling guide 60 does not come into contact with the belt 50.

Figure 4:
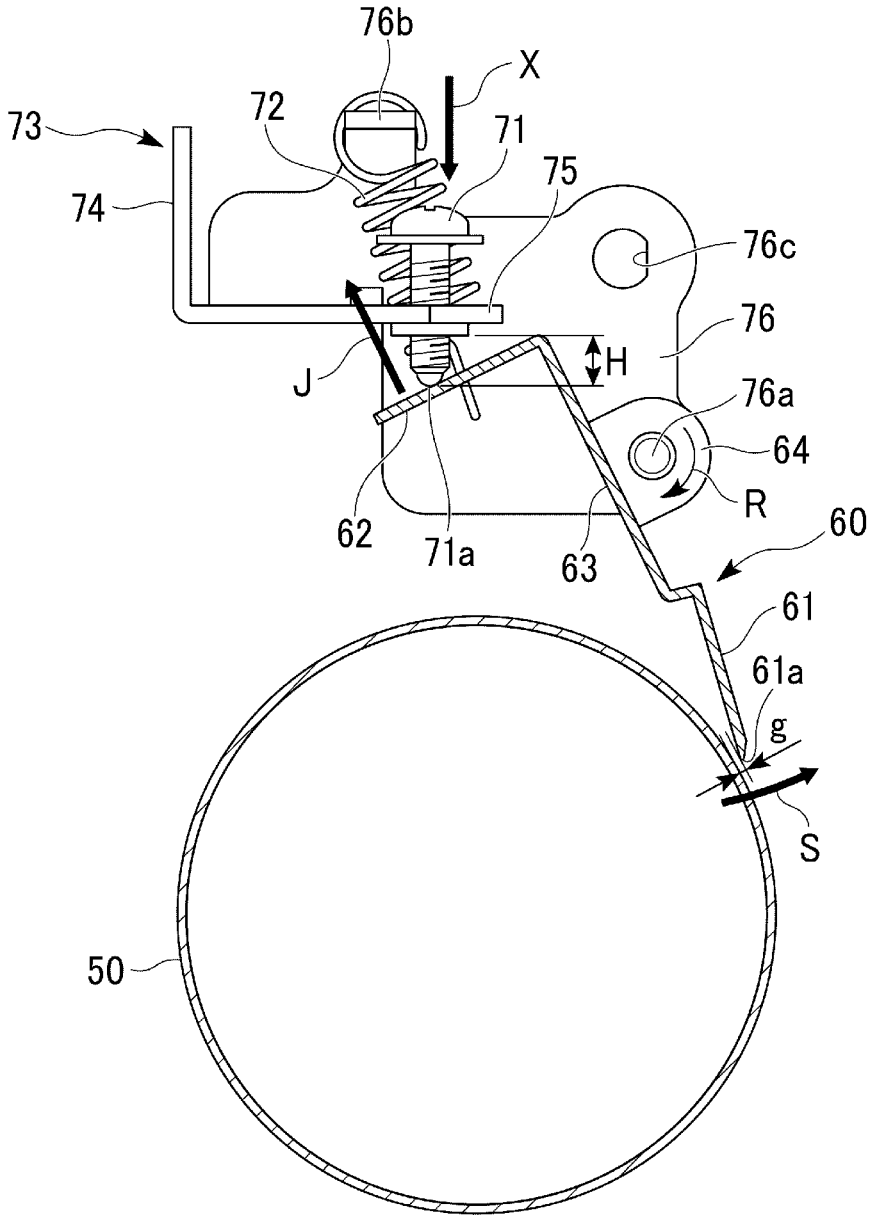
FIG. 4 is an explanatory view of an operation of a peeling guide of the embodiment.
Figure 5:
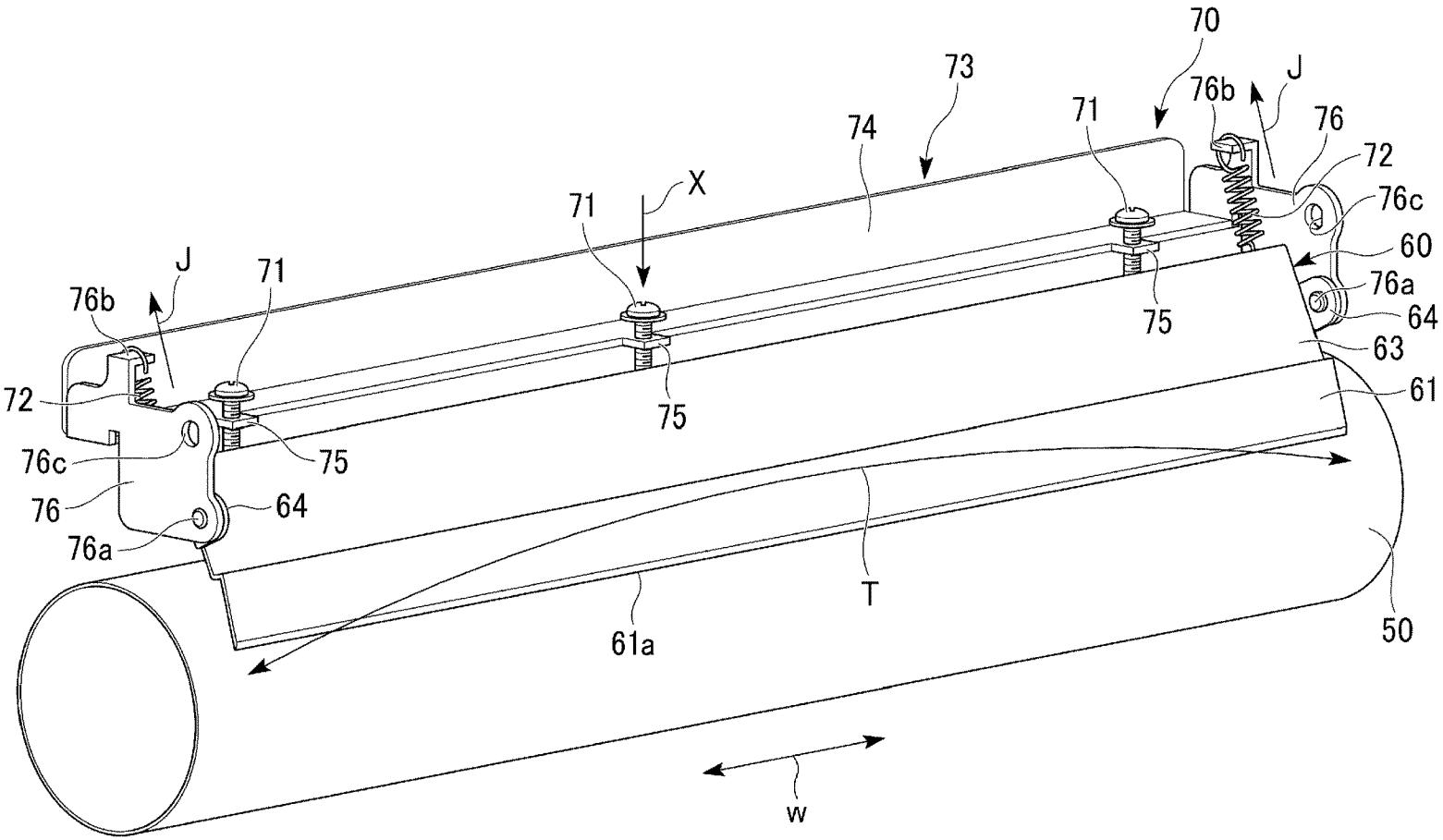
FIG. 5 is an explanatory view of the operation of the peeling guide of the embodiment.

FIG. 4 is a side view that is an explanatory view of an operation of the peeling guide 60 of the embodiment. FIG. 5 is a perspective view that is an explanatory view of the operation of the peeling guide 60 of the embodiment.

As illustrated in FIG. 5, the peeling guide 60 has a longitudinal axis in a direction along the belt width direction. As illustrated in FIG. 4, the peeling guide 60 has an L-shape in cross section.

The peeling guide 60 maintains a constant distance (gap g) with respect to the belt 50 such that the sheet P after fixing does not stick to the belt 50. For example, the gap g is set to a range of 0.5 mm to 0.8 mm.

The peeling guide 60 includes a transport guide portion 61, an adjuster abutting portion 62 (adjusting device abutting portion), a connecting portion 63, and shaft support portions 64. For example, the peeling guide 60 is formed of a resin material. The transport guide portion 61, the adjuster abutting portion 62, the connecting portion 63, and the shaft support portion 64 are integrally formed of the same material.

The transport guide portion 61 is positioned along the transporting path 33 (see FIG. 2). The transport guide portion 61 guides the sheet P. The transport guide portion 61 has a rectangular plate shape having a longitudinal side extending in a direction along the belt width direction. The transport guide portion 61 has a lateral side extending in a direction along the transporting direction v of the sheet P. An edge of the transport guide portion 61 at the upstream side thereof has a pointed shape protruding toward the belt 50. In other words, the peeling guide 60 has a pointed shape protruding toward the belt 50.

The adjuster abutting portion 62 is further from the belt 50 than the transport guide portion 61. One or more adjusters 71 of the adjusting device 70 abut against the adjuster abutting portion 62. The adjuster abutting portion 62 has a rectangular plate shape having a longitudinal side extending in a direction along the belt width direction. The adjuster abutting portion 62 has a lateral side extending in a direction that intersects a plane defined by the transport guide portion 61 at a location downstream of the transport guide portion 61 in the sheet transport direction v.

The connecting portion 63 connects the transport guide portion 61 and the adjuster abutting portion 62. Specifically, the connecting portion 63 connects an end portion of the transport guide portion 61 on the downstream side thereof and an end portion of the adjuster abutting portion 62 nearest to the transporting path 33. The connecting portion 63 has a longitudinal side in a direction along the belt width direction. The connecting portion 63 has an L-shape in cross section. The connecting portion 63 extends from the end portion of the transport guide portion 61 on the downstream side thereof away from the transporting path 33 and then bends to linearly extend toward the end portion of the adjuster abutting portion 62 nearest the transporting path 33.

As illustrated in FIG. 5, the shaft support portions 64 are provided at both ends of the connecting portion 63 in the longitudinal direction. The shaft support portions 64 form pivot points of the peeling guide 60. The shaft support portions 64 are disposed to avoid the transporting path 33 in the longitudinal direction of the connecting portion 63.

Next, the adjusting device 70 will be described.

The adjusting device 70 is disposed to avoid the transporting path 33. The adjusting device 70 moves an intermediate portion of the peeling guide 60 between the ends of the peeling guide 60 in the longitudinal direction, thus adjusting the gap g (see FIG. 4) between the peeling guide 60 and the belt 50 at one or more locations between the ends of the peeling guide 60. Here, the gap g means a gap between an edge 61*a* of the peeling guide 60 and an outer surface of the belt 50.

The adjusting device 70 includes the adjusters 71, biasing members 72, and a support member 73.

The adjuster 71 may be a screw type adjuster such as a bolt. A plurality (for example, three in the embodiment) of adjusters 71 are disposed at intervals along the longitudinal direction of the peeling guide 60. The adjusters 71 may be disposed at both ends of the peeling guide 60 and at the center between the ends in the longitudinal direction of the peeling guide 60. As illustrated in FIG. 4, the adjusters 71 are disposed on the downstream side of the peeling guide 60. A screw tip of the adjuster 71 abuts against the surface of the adjuster abutting portion 62 of the peeling guide 60.

For example, the biasing member 72 may be a coil spring. As illustrated in FIG. 5, the biasing members 72 are disposed at the ends of the peeling guide 60. The biasing members 72 bias the peeling guide 60 in an arrow direction J. Specifically, the biasing members 72 bias the peeling guide 60 in a direction in which the peeling guide 60 approaches the belt 50. That is, the biasing members 72 cause the tip 61*a* of the peeling guide 60 to approach the outer surface of the belt 50.

The biasing members 72 apply a force to the adjuster abutting portion 62 of the peeling guide that is generally along the sheet transport direction v (see FIG. 4). The force operates to apply a torque to the peeling guide 60 about the pivots points at the shaft support portions 64. The torque tends to rotate the peeling guide 60 in the direction q (see FIG. 2. The edge 61*a* of the peeling guide 60 is thus biased toward the surface of the belt 50.

The support member 73 includes a base wall 74, adjuster support pieces 75, and side walls 76. For example, the support member 73 is formed of a resin material. The base wall 74, the adjuster support pieces 75, and the side walls 76 are integrally formed of the same material.

The base wall 74 has a longitudinal side extending in a direction along the belt width direction. The base wall 74 has an L-shape in cross section (see FIG. 4).

The adjuster support pieces 75 are connected to an end portion of the base wall 74 nearest the transporting path 33.

A plurality (for example, three in the embodiment) of adjuster support pieces 75 are disposed at intervals in the longitudinal direction of the base wall 74. The adjuster support pieces 75 may be disposed at both ends of the base wall 74 and at a center of the base wall 74. The base wall 74 movably supports the adjusters 71. Specifically, each adjuster support piece 75 has a female screw portion to which a male screw portion of the corresponding adjuster 71 is screwed.

For example, the adjuster 71 is movable in an arrow direction X by rotating a head portion of the adjuster 71 in a clockwise (right) direction using a tool such as a screwdriver. In this case, a protrusion amount H (see FIG. 4) of a tip 71*a* of the adjuster 71 with respect to the adjuster support piece 75 is increased. The adjuster 71 is movable in a direction opposite to the arrow direction X by rotating the head portion of the adjuster 71 in a counterclockwise (left) direction. In this case, the protrusion amount H of the tip 71*a* of the adjuster 71 with respect to the adjuster support piece 75 is decreased.

The side walls 76 are provided at both ends of the base wall 74. The side walls 76 are disposed to avoid the transporting path 33 in the longitudinal direction of the base wall 74. Each side wall 76 includes a shaft portion 76*a*, a biasing member engaging portion 76*b*, and a side wall mounting portion 76*c*.

The shaft portion 76*a* is a support pin protruding inwardly along the longitudinal direction of the base wall 74. The shaft portion 76*a* rotatably supports the shaft support portion 64.

The biasing member engaging portion 76*b* is a claw portion protruding inwardly along the longitudinal direction of the base wall 74. An end portion of the biasing member 72 is engaged with the biasing member engaging portion 76*b*.

The side wall mounting portion 76*c* is a portion having a through-hole formed through the side walls 76. For example, the side wall mounting portion 76*c* is fixed to the frame 80 such that a fixture 83 is inserted into the through-hole (see FIG. 2).

Next, an example of an operation of the peeling guide 60 will be described.

As illustrated in FIG. 4, both ends of the adjuster abutting portion 62 of the peeling guide 60 are biased in the arrow direction J by the biasing members 72. Therefore, the peeling guide 60 rotates around the shaft support portion supporting portion 76*a* in an arrow direction R (as noted above, this is the same rotation direction as the rotation direction q of FIG. 2). That is, the tip 61*a* of the peeling guide 60 is biased toward the outer surface of the belt 50.

The center portion of the adjuster abutting portion 62 in the peeling guide 60 in the longitudinal direction receives a load in the arrow direction X by the adjuster 71. That is, the adjuster 71 moves in the arrow direction X against a biasing force of the biasing member 72 and thereby the center portion of the adjuster abutting portion 62 in the longitudinal direction is biased in a direction opposite to the arrow direction J. Therefore, the center portion of the edge 61*a* of the peeling guide 60 in the longitudinal direction is displaced in an arrow direction S. Therefore, the center portion of the edge 61*a* of the peeling guide 60, in the longitudinal direction, is displaced further from the belt 50 than both-ends of the edge 61*a* of the peeling guide 60. Therefore, as illustrated in FIG. 5, the edge 61*a* of the peeling guide 60 is deformed in an arrow direction T. Thus, the edge 61*a* of the peeling guide 60 is bent in an arc shape so as to follow the shape (see FIG. 3) of the belt 50.

According to the embodiment, MFP 10 includes the belt 50, the peeling guide 60, and the adjusting device 70. The belt 50 is disposed in the transporting path 33. The belt 50 transports the sheet P. The peeling guide 60 separates the sheet P from the belt 50. The peeling guide 60 has the longitudinal side extending in the belt width direction. The adjusting device 70 is disposed to avoid the transporting path 33. The adjusting device 70 moves the intermediate portion of the peeling guide 60, between the ends of the peeling guide 60, thus adjusting the gap g between the peeling guide 60 and the belt 50 at the intermediate portion. With the configuration described above, the following effects are achieved. It is possible to make the gap g of the peeling guide 60 in the longitudinal direction be uniform compared to a case where the gap is adjusted only at the ends of the peeling guide. Therefore, it is possible to easily keep an entire region of the peeling guide 60 in the longitudinal direction in a defined gap tolerance. Particularly, if the shape of the intermediate portion of the belt 50 in the belt width direction is curved, it is possible to effectively make the gap g of the peeling guide 60 in the longitudinal direction be uniform. If the gap is adjusted only at the two locations of the both ends of the peeling guide in the longitudinal direction, the edge of the peeling guide can come into contact with the portion of the belt which has the curved shape. However, according to the embodiment, the intermediate portion of the peeling guide 60 in the longitudinal direction is moved toward the press roller and away from the belt and thereby the gap g is adjusted. As a result, it is possible to avoid contact between the edge 61*a* of the peeling guide 60 and the curved portion of the belt 50. Therefore, even if the intermediate portion of the belt 50 in the belt width direction is curved, it is possible to make the gap g of the peeling guide 60 in the longitudinal direction be uniform. In addition, it is possible to suppress occurrence of jam such as paper jam during the transport of the sheet P compared to a case where the adjusting device is disposed in the transporting path.

The L-shaped cross-section of the peeling guide 60 provides increased rigidity compared to a case where the peeling guide has a simple plate shape.

Including the transport guide portion 61 as part of the peeling guide 60 simplifies the device configuration compared to a case where the transport guide portion is a separate piece from the peeling guide. In addition, sheet transportation stability is improved.

The configuration of the peeling guide 60, including the adjuster abutting portion 62 abutting against the adjuster 71, provides a way to apply the load from the adjuster 71 directly to the adjuster abutting portion 62 during adjusting the gap g. It is thus possible to slightly displace the edge 61*a* of the peeling guide 60 compared to a case where the load is directly applied to the transport guide portion 61. Therefore, a fine adjustment of the gap g is easily performed.

The configuration of the peeling guide 60, including the connecting portion 63 connecting the transport guide portion 61 and the adjuster abutting portion 62, provides increased rigidity of the peeling guide 60.

The configuration of the peeling guide 60, including the shaft support portions 64 which are provided at the ends of the connecting portion 63, provides the pivot points of the peeling guide 60 to stably rotate the peeling guide 60 compared to a case where the shaft support portion 64 is provided only at one end of the connecting portion 63.

The adjusting device 70 includes the screw type adjuster 71 disposed at the center of the peeling guide 60 in the longitudinal direction, providing fine adjustment of the gap g. In addition, it is possible to easily make the gap g of the peeling guide 60 in the longitudinal direction more uniform compared to a case where the adjuster 71 is disposed on one end or the other of the peeling guide 60 in the longitudinal direction (that is, greatly displaced from the center). Particularly, the present configuration is suitable for a case where the center portion of the belt 50 is curved.

The configuration of the adjusting device 70, including the plurality of screw type adjusters 71 disposed at intervals in the longitudinal direction of the peeling guide 60, provides the capability to adjust the peeling guide at a plurality of positions between the ends of the peeling guide 60. In this way, it is possible to easily make the gap g of the peeling guide 60 more uniform in the longitudinal direction compared to a case where the adjuster 71 is provided at only one location.

The location of the adjusting device 70, including the downstream location of the screw type adjusters 71, provides easy access to adjust the gap g.

The configuration of the biasing members 72 causes the edge 61*a* of the peeling guide 60 to stably approach the outer surface of the belt 50.

Hereinafter, modification examples will be described.

The fixing device 34 is not limited to the electromagnetic induction heating system (IH system) for electromagnetic induction heating the heating layer of the belt 50. For example, the fixing device 34 may be a lamp heating method. That is, the rotating member may be a heat roller. In addition, the belt 50 may be bridged over a plurality of rollers.

The biasing member 72 is not limited to a case of biasing the peeling guide 60 in the direction in which the peeling guide 60 approaches the belt 50. For example, the biasing member 72 may bias the peeling guide 60 in a direction in which the peeling guide 60 moves away from the belt 50. That is, the biasing member 72 may cause the tip 61*a* of the peeling guide 60 to move away from the outer surface of the belt 50.

The screw tip of the adjuster 71 is not limited to a case of abutting against the surface of the adjuster abutting portion 62 of the peeling guide 60. For example, the screw tip of the adjuster 71 may abut against a rear surface of the adjuster abutting portion 62 of the peeling guide 60.

For example, the support member 73 may be attached to the side walls 76 at a location between the abutting portion 62 of the peeling guide 60 and the belt 50. The adjuster 71 may thus be disposed with the tip thereof abutting the surface of the adjuster abutting portion 62 facing the belt 50 and biasing members 72 attached to a feature of the side walls 76 likewise between the adjuster abutting portion 62 and the belt 50. Instead of a screw-type adjuster, a bolt-type may be used for easy access using a thin wrench-type tool. In this way, the biasing members 72 provide a force that tends to rotate the edge 61*a* of the peeling guide 60 away from the belt 50, while the adjusters 71 tend to push portions of the edge 61*a* of the peeling guide 60 toward the belt 50.

The outer shape of the belt 50 is not limited to a case of having the outward curved shape at the center in the belt width direction. For example, the outer shape of the belt 50 may have an inward curved shape, or a flat shape, at the center in the belt width direction.

According to at least one embodiment described above, the belt 50, the peeling guide 60, and the adjusting device 70 are provided. The belt 50 is provided in the transporting path 33. The belt 50 transports sheet P. The peeling guide 60 separates the sheet P from the belt 50. The peeling guide 60 has a longitudinal side extending in the belt width direction. The adjusting device 70 is disposed to avoid the transporting path 33. The adjusting device 70 moves an intermediate portion of the peeling guide 60 between the ends of the peeling guide 60 and adjusts the gap g between the peeling guide 60 and the belt 50. In this way, it is possible to make the gap g of the peeling guide 60 in the longitudinal direction more uniform compared to a case where the gap is adjusted at only the ends of the peeling guide.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a rotating member configured to transport a sheet in a sheet transporting direction;

a pressing member configured to form a nip with the rotating member;

a peeling guide that is disposed on a downstream side of the rotating member in the sheet transporting direction, has a longitudinal side extending along an axial direction of the rotating member, and is configured to separate the sheet from the rotating member; and an adjusting device that is controlled to move the peeling guide to adjust a gap between an intermediate portion of the peeling guide and the rotating member by a greater amount than gaps between longitudinal ends of the peeling guide and the rotating member.

2. The apparatus according to claim 1, wherein the peeling guide has an L-shape in cross section.

3. The apparatus according to claim 2, wherein the peeling guide includes a transport guide portion that guides the sheet.

4. The apparatus according to claim 3, wherein the peeling guide further includes an adjusting device abutting portion that abuts against the adjusting device.

5. The apparatus according to claim 4, wherein the peeling guide further includes:

a connection portion that connects an end portion of the transport guide portion on a downstream side thereof and an end portion of the adjusting device abutting portion nearest to a transporting path of the sheet; and a shaft support portion at each longitudinal end of the connection portion.

6. The apparatus according to claim 1, wherein the adjusting device includes a screw type adjuster that is disposed at a central portion of the peeling guide between the two longitudinal ends of the peeling guide.

7. The apparatus according to claim 1, wherein the adjusting device includes a plurality of screw type adjusters which are separated from each other in the longitudinal direction of the peeling guide.

8. The apparatus according to claim 7, wherein the plurality of adjusters are configured to enable adjustment of the gap between the peeling guide and the rotating member at different locations.

9. The apparatus according to claim 1, wherein the adjusting device includes a screw type adjuster disposed on a downstream side of the peeling guide in the sheet transport direction.

10. The apparatus according to claim 1, wherein the adjusting device further includes biasing members that are disposed at the two longitudinal ends of the peeling guide and bias the peeling guide with respect to the rotating member.

11. An image forming apparatus comprising:

a rotating member configured to transport a sheet;

a pressing member configured to form a nip with the rotating member;

a peeling guide that is disposed on a downstream side of the rotating member in a sheet transporting direction, has a longitudinal side extending in a direction along an axial direction of the rotating member, and is configured to separate the sheet from the rotating member; and an adjusting device configured to adjust a gap between the peeling guide and the rotating member by deforming a shape of an intermediate portion of the peeling guide.

12. The apparatus according to claim 11, wherein the peeling guide includes an edge which separates the sheet from the rotating member and an adjuster device abutting portion, wherein the adjusting device further includes an adjuster, and wherein the adjusting device deforms the shape of the intermediate portion of the peeling guide by the adjuster coming into contact with the adjuster abutting portion.

13. The apparatus according to claim 12, wherein the peeling guide includes a transport guide portion between the edge and the adjuster device abutting portion.

14. The apparatus according to claim 13, wherein the peeling guide further includes a connection portion which connects the transport guide portion and the adjusting device abutting portion, and which includes a shaft support portion at each longitudinal end of the connection portion.

15. The apparatus according to claim 12, wherein the adjusting device includes a screw type adjuster that is disposed at a central portion of the peeling guide between the two longitudinal ends of the peeling guide.

16. The apparatus according to claim 15, wherein the adjusting device includes a plurality of screw type adjusters which are separated from each other in the longitudinal direction of the peeling guide.

17. The apparatus according to claim 16, wherein each screw type adjuster is configured to enable adjustment of the gap between the peeling guide and the rotating member at a different location.

18. The apparatus according to claim 12, wherein the adjusting device further includes biasing members that are disposed at the two longitudinal ends of the peeling guide and bias the peeling guide in a direction with respect to the rotating member.

19. The apparatus according to claim 11, wherein the peeling guide has a non-linear shape in cross section.

20. An image forming apparatus comprising:

a rotating member configured to transport a sheet in a sheet transporting direction;

a pressing member configured to form a nip with the rotating member;

a peeling guide that is disposed on a downstream side of the rotating member in the sheet transporting direction, has a longitudinal edge extending along an axial direction of the rotating member, the longitudinal edge being positioned to close to a surface of the rotating member to separate the sheet from the rotating member; and an adjusting device having a plurality of adjusters configured to adjust a size of the gap at different locations including a location that is closer to a center of the peeling guide in the longitudinal direction than a longitudinal end of the peeling guide.

21. The apparatus according to claim 1, wherein a bottom portion of the adjusting device contacts the peeling guide.

* * * * *